US009000687B2

(12) United States Patent
Lai

(10) Patent No.: US 9,000,687 B2
(45) Date of Patent: Apr. 7, 2015

(54) METHOD FOR MIXING LIGHT OF LEDS AND LIGHTING DEVICE USING SAME

(71) Applicant: Hon Hai Precision Industry Co., Ltd., New Taipei (TW)

(72) Inventor: Chih-Chen Lai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/886,282

(22) Filed: May 3, 2013

(65) Prior Publication Data

US 2014/0167644 A1 Jun. 19, 2014

(30) Foreign Application Priority Data

Dec. 18, 2012 (TW) ..... 101148174 A

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0866* (2013.01)

(58) Field of Classification Search

None

See application file for complete search history.

(56) References Cited

U.S. PATENT DOCUMENTS

| | | | | |
|---|---|---|---|---|
| 7,638,754 | B2 * | 12/2009 | Morimoto et al. | 250/226 |
| 7,888,623 | B2 * | 2/2011 | Kawashima et al. | 250/205 |
| 2012/0139968 | A1 * | 6/2012 | Adachi | 345/690 |

* cited by examiner

*Primary Examiner* — Anh Tran

(74) *Attorney, Agent, or Firm* — Novak Druce Connolly Bove + Quigg LLLP

(57) ABSTRACT

A method for mixing light of LEDs includes following steps: Firstly, a substrate with a red light LED, a green light LED and a blue light LED arranged thereon is provided. Secondly, a power source for supplying power to the red light LED, the green light LED and the blue light LED is provided. Thirdly, a temperature variation ΔT1 of the red light LED caused by the power source, a temperature variation ΔT2 of the green light LED caused by the power source, a temperature variation ΔT3 of the blue light LED caused by the power source are calculated. And finally, input currents applied to the red light LED, the green light LED and the blue light LED are adjusted according to the temperature variations ΔT1, ΔT2 and ΔT3. A lighting device using the method is also provided.

7 Claims, 3 Drawing Sheets

METHOD FOR MIXING LIGHT OF LEDS AND LIGHTING DEVICE USING SAME

BACKGROUND

1. Technical Field

The disclosure generally relates to a method for mixing light of LEDs and a lighting device using the method.

2. Description of Related Art

In recent years, due to excellent light quality and high luminous efficiency, light emitting diodes (LEDs) have increasingly been used as substitutes for incandescent bulbs, compact fluorescent lamps and fluorescent tubes as light sources of illumination devices.

Generally, a white light is provided by mixing light from a red light LED, a green light LED and a blue light LED. Since a peak wavelength of an LED will change according to a change of temperature, a temperature sensor is usually applied to the LED to monitor the change of temperature. When the temperature of the LED increases, an input current of the LED is decreased to avoid the temperature of the LED from continuously increasing. However, since the input current of the LED is decreased after the increasing of the temperature of the LED, there is a risk that the temperature of the LED has already been increased to an unacceptable value before the input current of the LED is decreased enough to bring the temperature down.

What is needed, therefore, is a method of mixing light of LEDs and a lighting device using the method to overcome the above described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments of a lighting device and a method for mixing light of LEDs of the lighting device will now be described in detail below and with reference to the drawings.

Figure 1:
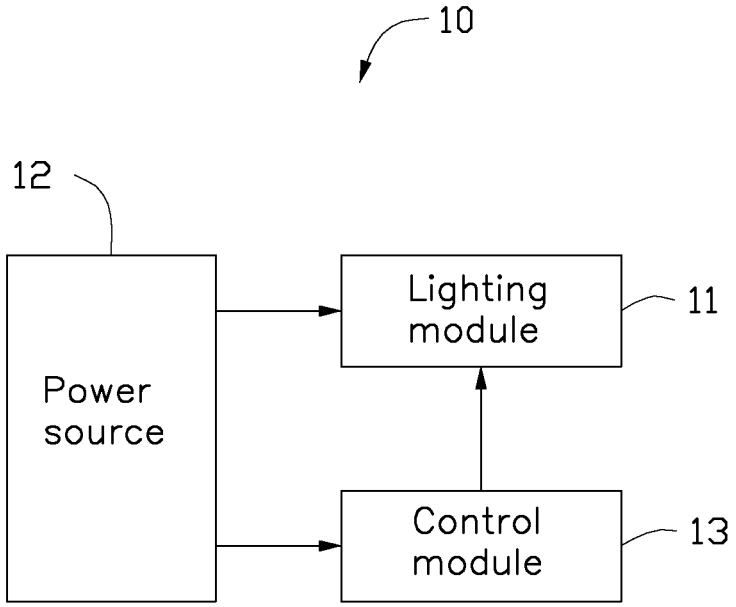
FIG. 1 is an illustrating view of a lighting device in accordance with an embodiment of the present disclosure.
Figure 2:
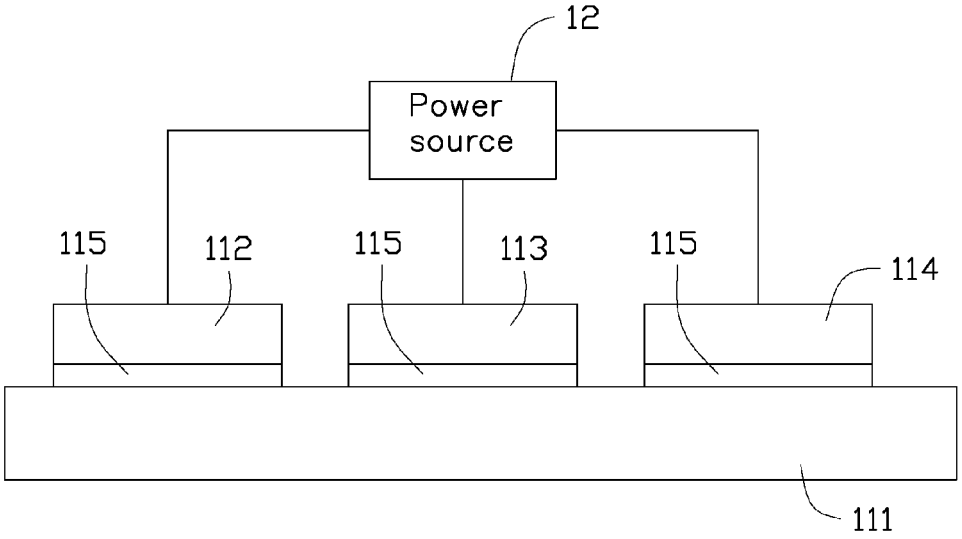
FIG. 2 is an illustrating view of a lighting module of the lighting device in FIG. 1.

Referring to FIGS. 1-2, a lighting device 10 in accordance with an embodiment is provided. The lighting device 10 includes a lighting module 11, a power source 12 and a control module 13.

The lighting module 11 includes a substrate 111, and a red light LED 112, a green light LED 113 and a blue light LED 114 arranged on the substrate 111. The power source 12 is provided for supplying power for the red light LED 112, the green light LED 113 and the blue light LED 114.

The control module 13 is electrically connected with the lighting module 11 and the power source 12. The control module 13 calculates a temperature variation ΔT1 of the red light LED 112 caused by the power source 12, a temperature variation ΔT2 of the green light LED 113 caused by the power source 12, and a temperature variation ΔT3 of the blue light LED 114 caused by the power source 12. For example, if the power of the power source 12 provided to the red light LED 112 is increased from $Q_{11}$ to $Q_{12}$, that means an addition power $Q_{12}$-$Q_{11}$ is provided to the red light LED 112. The addition power $Q_{12}$-$Q_{11}$ will make a temperature of the red light LED 112 increase from $T_{11}$ to $T_{12}$. Therefore, the temperature variation ΔT1 of the red light LED 112 is calculated as $\Delta T1=T_{12}-T_{11}$. According to the temperature variations ΔT1, ΔT2 and ΔT3, the control module 13 adjusts input currents of the red light LED 112, the green light LED 113 and the blue light LED 114 respectively. That is, when an input power provided to the red light LED 112 increases, heat generated by the red light LED 112 will increase a temperature of the red light LED 112. The increasing of temperature of the red light LED 112 will change a peak wavelength of light emitted by the red light LED 112. Therefore, a proportion of the red light between the green light and the blue light in the lighting device 10 is changed. Therefore, the control module 13 will decrease the input current of the red light LED 112, and make the proportion of the red light between the green light and the blue light in the lighting device 10 keep in balance. Correspondingly, when an input power provided to the green light LED 113 or the blue light LED 114 increases, the control module 13 may decrease the input current of the green light LED or the blue light LED and make the proportion of the red light between the green light and the blue light in the lighting device 10 keep in balance.

In this embodiment, before calculating the temperature variation ΔT1 of the red light LED 112, the temperature variation ΔT2 of the green light LED 113 and the temperature variation ΔT3 of the blue light LED 114, the control module 13 can firstly calculate an amount of heat Q1 generated by the red light LED 112 caused by the power source 12, an amount of heat Q2 generated by the green light LED 113 caused by the power source 12, and an amount of heat Q3 generated by the blue light LED 114 caused by the power source 12, wherein the amount of heat Q1, Q2 and Q3 can be calculated as according to following expression: Q=U*I*t. According to the amount of heat Q1, Q2 and Q, the control module 13 calculates the temperature variations ΔT1, ΔT2 and ΔT3. During the calculation, a thermal resistance $R_R$ of the red light LED 112, a thermal resistance $R_G$ of the green light LED 113, and a thermal resistance $R_B$ of the blue light LED 114 are provided. The values of the thermal resistance $R_R$, $R_G$ and $R_B$ represent a temperature variation caused by the amount of heat of 1 watt (W). Therefore, the temperature variations ΔT1, ΔT2 and ΔT3 of the red light LED 112, the green light LED 113 and the blue light LED 114 can be calculated as according to following expression:

$$\Delta T1=Q1*R_R;\ \Delta T2=Q2*R_G;\ \Delta T3=Q3*R_B.$$

Preferably, three solder layers 115 are formed respectively on an interface between the red light LED 112 and the substrate 111, an interface between the green light LED 113 and the substrate 111, and an interface between the blue light LED 114 and the substrate 111. At that time, when calculating the temperature variation ΔT, ΔT2 and ΔT3 of the red light LED 112, the green light LED 113 and the blue light LED 114, a thermal resistance $R_S$ is firstly provided. The temperature variations ΔT1, ΔT2 and ΔT3 of the red light LED 112, the green light LED 113 and the blue light LED 114 can be calculated as according to following expression:

$$\Delta T1=Q1*(R_R+R_S);\ \Delta T2=Q2*(R_G+R_S);\ \Delta T3=Q3*(R_B+R_S).$$

Figure 3:
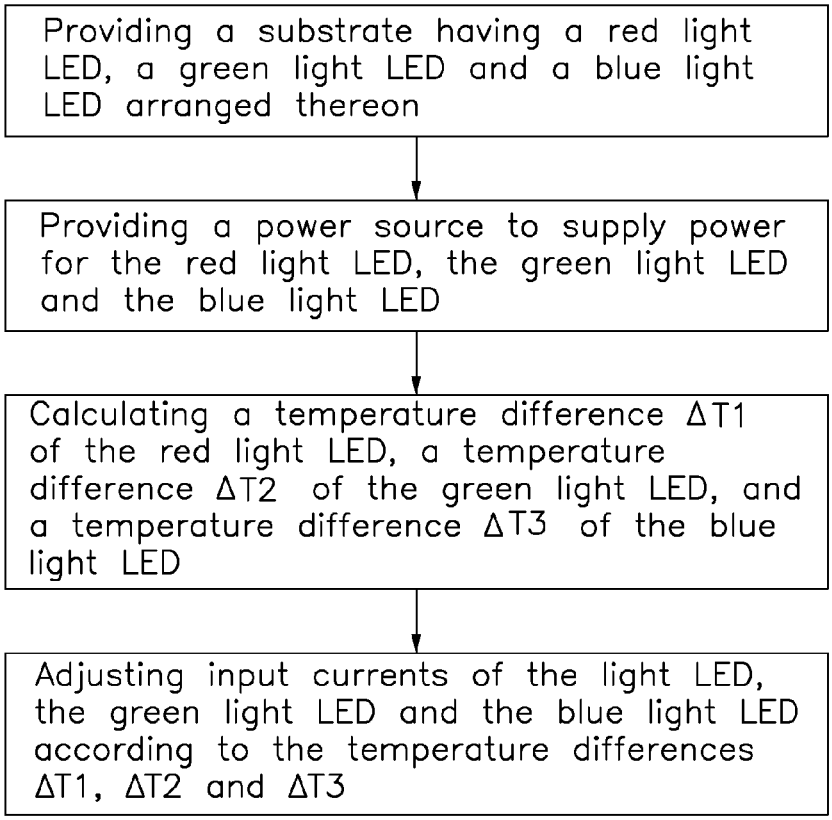
FIG. 3 is a flow chart of a method for mixing light of LEDs of the lighting device in FIG. 1.

A method for mixing light of LEDs is also provided. Referring also to FIG. 3, the method for mixing light of LEDs includes following steps.

Firstly, a substrate 111 is provided. The substrate 111 has a red light LED 112, a green light LED 113 and a blue light LED 114 arranged thereon.

Secondly, a power source 12 is provided for supplying power for the red light LED 112, the green light LED 113 and the blue light LED 114, whereby red light, green light and blue light are generated and mixed together to become white light.

Thirdly, a temperature variation ΔT1of the red light LED 112 caused by the power source 12 is calculated, a temperature variation ΔT2 of the green light LED 113 caused by the power source 12 is calculated, and a temperature variation ΔT3 of the blue light LED 114 caused by the power source 12 is calculated.

According to the temperature variations ΔT1, ΔT2 and ΔT3, input currents of the red light LED 112, the green light LED 113 and the blue light LED 114 are adjusted respectively.

Before calculating the temperature variation ΔT1of the red light LED 112, the temperature variation ΔT2 of the green light LED 113 and the temperature variation ΔT3 of the blue light LED 114, the control module 13 can firstly calculate an amount of heat Q1 generated by the red light LED 112 caused by the power source 12, an amount of heat Q2 generated by the green light LED 113 caused by the power source 12, and an amount of heat Q3 generated by the blue light LED 114 caused by the power source 12. According to the heat Q1, Q2 and Q3, the control module 13 calculates the temperature variations ΔT1, ΔT2 and ΔT3. During the calculation, a thermal resistance $R_R$ of the red light LED 112, a thermal resistance $R_G$ of the green light LED 113, and a thermal resistance $R_B$ of the blue light LED 114 are provided. The values of the thermal resistance $R_R$, $R_G$ and $R_B$ represent a temperature variation caused by the amount of heat of 1 W. The temperature variations ΔT1, ΔT2 and ΔT3 of the red light LED 112, the green light LED 113 and the blue light LED 114 can be calculated as according to following expression:

$$\Delta T1=Q1*R_R;\ \Delta T2=Q2*R_G;\ \Delta T3=Q3*R_B.$$

Preferably, solder layers 115 are formed respectively between the red light LED 112 and the substrate 111, between the green light LED 113 and the substrate 111, and between the blue light LED 114 and the substrate 111. At that time, when calculating the temperature variation ΔT1, ΔT2 and ΔT3 of the red light LED 112, the green light LED 113 and the blue light LED 114, a thermal resistance $R_S$ is firstly provided. The temperature variations ΔT1, ΔT2 and ΔT3 of the red light LED 112, the green light LED 113 and the blue light LED 114 can be calculated as according to following expression:

$$\Delta T1=Q1*(R_R+R_S);\ \Delta T2=Q2*(R_G+R_S);\ \Delta T3=Q3*(R_B+R_S).$$

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A method for mixing light of LEDs, comprising following steps:

providing a substrate with a red light LED, a green light LED and a blue light LED arranged thereon;

providing a power source for supplying power for the red light LED, the green light LED and the blue light LED;

calculating a temperature variation ΔT1 of the red light LED caused by the power source, a temperature variation ΔT2 of the green light LED caused by the power source, and a temperature variation ΔT3 of the blue light LED caused by the power source; and adjusting input currents applied to the red light LED, the green light LED and the blue light LED according to the temperature variations ΔT1, ΔT2 and ΔT3;

wherein before calculating the temperature variation ΔT1 of the red light LED, the temperature variation ΔT2 of the green light LED and the temperature variation ΔT3 of the blue light LED, an amount of heat Q1 of the red light LED generated by the power source, an amount of heat Q2 of the green light LED generated by the power source, and an amount of heat Q3 of the blue light LED generated by the power source are calculated, the temperature variations ΔT1, ΔT2 and ΔT3 are calculated according to the amounts of heat Q1, Q2 and Q3; and wherein a thermal resistance $R_R$ of the red light LED, a thermal resistance $R_G$ of the green light LED, and a thermal resistance $R_B$ of the blue light LED are provided, and the temperature variations ΔT1, ΔT2 and ΔT3 are calculated according to following expression:

$$\Delta T1=Q1*R_R;\ \Delta T2=Q2*R_G;\ \Delta T3=Q3*R_B.$$

2. The method of claim 1, wherein solder layers are formed between the red light LED and the substrate, the green light LED and the substrate, and the blue light LED and the substrate respectively.

3. The method of claim 2, wherein a thermal resistance $R_s$ of the solder layers is provided, and the temperature variations ΔT1, ΔT2 and ΔT3 are calculated according to following expression:

$$\Delta T1=Q1*(R_R+R_S);\ \Delta T2=Q2*(R_G+R_S);\ \Delta T3=Q3*(R_B+R_S).$$

4. A lighting device, comprising:

a lighting module, comprising a substrate and a red light LED, a green light LED and a blue light LED formed on the substrate;

a power source, supplying power for the red light LED, the green light LED and the blue light LED respectively; and a control module, electrically connected with the lighting module and the power source, the control module calculating a temperature variation ΔT1 of the red light LED caused by the power source, a temperature variation ΔT2 of the green light LED caused by the power source, a temperature variation ΔT3 of the blue light LED caused by the power source, and adjusting input currents to the red light LED, the green light LED and the blue light LED according to the temperature variations ΔT1, ΔT2 and ΔT3;

wherein before calculating the temperature variation ΔT1 of the red light LED, the temperature variation ΔT2 of the green light LED and the temperature variation ΔT3 of the blue light LED, an amount of heat Q1 of the red light LED generated by the power source, an amount heat Q2 of the green light LED generated by the power source, and an amount of heat Q3 of the blue light LED generated by the power source are calculated, the temperature variations ΔT1, ΔT2 and ΔT3 are calculated according to the amounts of heat Ql, Q2 and Q3; and wherein a thermal resistance $R_R$ of the red light LED, a thermal resistance $R_G$ of the green light LED, and a thermal resistance $R_B$ of the blue light LED are provided, the temperature variations ΔT1, ΔT2 and ΔT3 are calculated according to following expression:

$$\Delta T1=Q1*R_R;\ \Delta T2=Q2*R_G;\ \Delta T3=Q3*R_B.$$

5. The lighting device of claim 4, wherein solder layers are formed between the red light LED and the substrate, the green light LED and the substrate, and the blue light LED and the substrate respectively.

6. The lighting device of claim 5, wherein a thermal resistance $R_s$ of the solder layers is provided, and the temperature variations ΔT1, ΔT2 and ΔT3 are calculated as according to following expression:

$$\Delta T1=Q1*(R_R+R_S);\ \Delta T2=Q2*(R_G+R_S);\ \Delta T3=Q3*(R_B+R_S).$$

7. A method for mixing light of red, green and blue LEDs, comprising following steps:

providing the red, green and blue LEDs and applying input currents to the red, green and blue LEDs to drive the red, green and blue LEDs to generate light beams which are mixed together to generate white light;

calculating a temperature variation ΔT1 of the red light LED, a temperature variation ΔT2 of the green light LED, and a temperature variation ΔT3 of the blue light LED; and adjusting the input currents applied to the red light LED, the green light LED and the blue light LED according to the temperature variation ΔT1, ΔT2 and ΔT3;

wherein before calculating the temperature variation ΔT1 of the red light LED, the temperature variation ΔT2 of the green light LED and the temperature variation ΔT3 of the blue light LED, an amount of heat Q1 of the red light LED, an amount of heat Q2 of the green light LED, and an amount of heat Q3 of the blue light LED are calculated, the temperature variations ΔT1, ΔT2 and ΔT3 are calculated according to the amounts of heat Q1, Q2 and Q3; and wherein a thermal resistance $R_R$ of the red light LED, a thermal resistance $R_G$ of the green li ht LED and a thermal resistance $R_B$ of the blue light LED are provided, and the temperature variations ΔT1, ΔT2 and ΔT3 are calculated according to following expression:

$$\Delta T1=Q1*R_R;\ \Delta T2=Q2*R_G;\ \Delta T3=Q3*R_B.$$

* * * * *